US006164586A

United States Patent [19]

Johnson

[11] Patent Number: 6,164,586

[45] Date of Patent: Dec. 26, 2000

[54] SUPPORT DRUM ASSEMBLY WITH CROSS-SHAFT LINKAGE FOR VARIABLE BACKLASH CONTROL

[75] Inventor: Noel R. Johnson, Stoughton, Wis.

[73] Assignee: Beloit Technologies, Inc., Wilmington, Del.

[21] Appl. No.: 09/122,203

[22] Filed: Jul. 24, 1998

[51] Int. Cl.[7] ..... B65H 18/14; B65H 18/26

[52] U.S. Cl. ..... 242/542.3; 242/542.2; 242/542.4

[58] Field of Search ..... 242/542.2, 542.3, 242/542.4, 541

[56] References Cited

U.S. PATENT DOCUMENTS 5,370,327 12/1994 Adamski ..... 242/533.1
5,544,841 8/1996 Didier et al. ..... 242/541.1
5,560,566 10/1996 Bagnato ..... 242/541.1
5,673,870 10/1997 Fielding et al. ..... 242/542.3

*Primary Examiner*—John Q. Nguyen
*Attorney, Agent, or Firm*—Lathrop & Clark LLP

[57] ABSTRACT

A support drum assembly is provided for a torque, nip and web tension type of reel. The support drum assembly includes an actuating mechanism disposed at one end of the support drum which enables one end of the drum to be raised or lowered with respect to the other end of the drum for adjusting the amount of backlash while the machine is in operation. The support drum assembly includes a cross shaft linkage which will allow at least two different backlash settings to be used at any time during the machine operation.

25 Claims, 4 Drawing Sheets

SUPPORT DRUM ASSEMBLY WITH CROSS-SHAFT LINKAGE FOR VARIABLE BACKLASH CONTROL

FIELD OF THE INVENTION

The present invention relates to the reeling of a traveling web of paper, such as that which is continuously being produced by a papermaking machine. More specifically, the present invention relates to the winder or winding apparatus of the papermaking machine for affecting the continuous production of a wound paper web in a roll form. Still more specifically, the present invention relates to a reeling method and apparatus which utilizes an adjustable support drum and in which a reel spool upon which the web is wound is positioned on parallel, horizontally extending rails above the support drum. The support drum engages the reel and/or web to provide a nip load to the web. Still more specifically, the present invention relates to a support drum assembly whereby the vertical position of at least one end of the support drum may be varied with respect to the other end to thereby provide an adjustable backlash against the web.

BACKGROUND OF THE INVENTION

Paper is made by a continuous process on a papermaking machine. Paper is formed at the wet end of the papermaking machine, typically by depositing a slurry of paper fibers and water on a screen to form a mat. The mat of fibers on the screen is dewatered by press rolls and suction boxes and thereafter transferred to a progression of rollers where it is pressed and dried.

The final forming step in the papermaking process is to run the web of formed paper through a calendar or super calendar which compresses the web between opposing rollers and improves the surface finish and uniformity of the paper thickness. All processes involved in papermaking, from the forming of the paper at the wet end of the papermaking machine to the calendaring at the dry end of the papermaking machine are continuous in nature and each length of the paper web is intended to be subjected to the same processes and forces, thus forming a paper web of high uniformity.

However, the final step in the papermaking process, that of winding or reeling the paper web onto spools for removal from the papermaking machine can result in non5 uniform treatment of the paper web.

Specifically, a reel of paper produced by a papermaking machine typically has a diameter of 120 inches or more and a reel width of 200 to 400 inches. The reel of paper is further processed by rewinding and slicing and sometimes coating the paper to form individual reels or sets to be used by paper consuming customers (for example, newspapers). It is known that a paper web formed on large machine reels can be damaged near the edge of the sheet or web. The damage typically results in the web breaking when it is further processed in a paper coating or rewinding machine or as it is utilized in a printing press.

A set is a smaller reel or roll of paper which has been formed on a larger, or jumbo reel. The last set is paper which is nearest the center of the reel, or the paper that is first wound on the reel spool. Studies have shown that a high percentage of rejects constitute the last set of a reel. Specifically, as set forth in U.S. Pat. No. 5,560,566, 73% of the press room paper web breaks during printing were caused by the last set off the reel, or the paper that is disposed closest to the spool when the paper of the web is wound onto the reel.

With the increase in size of the rolls of paper being produced, the problems associated with existing paper reels have been exacerbated while at the same time the tolerance of such defects or waste has decreased due to competitive pressures, concern for efficiency and utilization of natural resources.

Prior to the mid-1990s, reels for reeling paper manufactured by papermaking machines were of the so-called Pope-type reels wherein a new reel spool is initially engaged by a pair of arms while the first few wraps of paper are wound onto the reel spool. The newly started wound web is then brought into nipping engagement with a support drum while the on-coming paper web continues to be wrapped around the new roll. As the wound paper roll begins to increase in diameter, it is rotated by the primary arms about the periphery of the support drum and transferred onto substantially, horizontally disposed support rails. On almost all existing Pope-type reels, torque could not be applied to the reel spool while it was held in the primary arms. As the reeled spool is rotated down to be supported on the support rails, a pair of secondary arms then maintains the wound paper roll and nipping engagement with the support drum with the nip in a substantially horizontal plane to the rotational axis of the paper roll being wound. Torque is applied to the wound paper roll being wound generally after it has been transferred to the secondary arm.

In Pope-type reels, the wound paper roll follows a complicated, non-smooth path from a location where the on-coming web is initially wrapped onto the new reel spool, to a point where it is brought into nipping engagement with the support drum and then rotated downwardly about the periphery of the support drum by the primary arms to the point where it is supported by the support rails as it is moved horizontally on the rails as the diameter of the wound web increases.

As set forth in U.S. Pat. Nos. 5,370,327, 5,554,841, 5,560,566 and 5,673,870, all assigned to Beloit Corporation, a substantial improvement to the Pope-type reel has been provided in the form of the TNT (torque, nip and web tension) type of reel disclosed in said patents. The solution provided by the TNT reels is to produce a more uniformly wrapped paper web on the reel by providing a support drum that moves translationally downwardly while maintaining nipping contact with the newly started reel spool as the reel spool passes over the support drum apex to the downstream side of the support drum while the reel spool maintains continuous supporting contact on the rails. In the embodiment disclosed in U.S. Pat. No. 5,370,327, actuators are provided on the downstream side of the support drum which enable the support drum to maintain continuous contact with the web roll until it reaches its desired diameter. A similar apparatus with respect to the support drum is disclosed in U.S. Pat. No. 5,544,841.

In contrast, in U.S. Pat. Nos. 5,560,566 and 5,673,870, the support drum is maintained in a stationary position and the nip pressure or nip load between the support drum and the roll is controlled by the force of gravity, the position of the roll along the rails and a conventional pneumatic or hydraulic cylinder or screw mechanism. In short, instead of adjusting the position of the support drum to adjust nip pressure, the nip pressure is controlled by manipulating the roll or reel.

In the designs disclosed in all of the aforementioned patents, the support drum is maintained in a level position. However, it has been found that certain instances may occur where it may be desirable to adjust the position of the support drum so that it deviates from a level or horizontal position in order to maintain a uniform nip load across the roll. Further, it has also been found that once the roll has passed over the support drum, it may be desirable, and necessary, to reduce the degree to which the support drum deviates from a horizontal or level position to ensure proper winding. A deviation in the position of the support drum from a level or horizontal position is often referred to as backlash. In short, it has been found that it would be desirable to be able to adjust the backlash settings, or the vertical position of one end of the support drum with respect to the other, during machine operation. Currently, no such apparatuses exist which would permit such a backlash adjustment during the operation of a papermaking machine.

SUMMARY OF THE INVENTION

The present invention provides a solution to the above-referenced deficiency by providing a support drum assembly for applying a nip load to a reel spool which can be adjusted to vary the amount of backlash during operation of the papermaking machine. The support drum of the present invention comprises a cross shaft comprising a first end and a second end. The first end of the cross shaft is supported by a first stationary frame. The second end of the cross shaft is similarly supported by a second stationary frame. The first end of the cross shaft is further connected to a first drum support bracket which, in turn, supports a first end of a support drum. The support drum also includes a second end. The second end of the cross shaft is connected to a link. The link is connected to a second drum support bracket and an actuator. The second drum support bracket supports the second end of the support drum. The actuator is capable of moving the link and the second end of the support drum vertically with respect to the first end of the support drum. The actuator may be actuated during operation of the papermaking machine to thereby adjust the vertical position of the second end of the support drum with respect to the first end of the support drum, or to adjust the backlash of the support drum, without shutting down the papermaking operation.

In an embodiment, the link that connects the cross shaft to the second drum support bracket further comprises a proximal end that is connected to the second end of the support shaft and a distal end that is connected to the actuator. The link further comprises an elongated slot disposed between the proximal and distal ends. The drum assembly further comprises a second mounting plate that comprises a cam roller. The cam roller is slidably received in the elongated slot of the link. The second mounting plate thereby connects the link to the second drum support bracket.

In an embodiment, the elongated slot comprises a first opposing end and a second opposing end. The first opposing end further comprises a hole that extends from the first opposing end of the slot through the link. The hole accommodates a minimum clearance stop bolt that comprises a distal end that extends into the elongated slot and prevents the cam roller from engaging the first opposing end of the elongated slot. The position of the stop bolt in the slot thereby adjusts the amount of minimum backlash that can be provided by the apparatus of the present invention.

In an embodiment, the second opposing end of the slot further comprises a hole that extends from the second opposing end of the slot through the link. This hole accommodates a maximum clearance stop bolt that comprises a distal end that extends into the elongated slot and prevents the cam roller from engaging the second opposing end of the slot. The position of the maximum clearance stop bolt in the slot thereby controls the maximum backlash adjustment available.

In an embodiment, the minimum clearance stop bolt comprises a head disposed on an opposing side of the link from the elongated slot. The drum assembly further comprises shim disposed between the head of the minimum clearance stop bolt and the link to thereby control the position of the distal end of the minimum clearance stop bolt in the elongated slot and to thereby control the minimum backlash available.

In an embodiment, the maximum clearance stop bolt similarly comprises a head disposed on an opposing side of the link from the elongated slot and the drum assembly further comprises shim disposed between the head of the maximum clearance stop bolt and the link for adjustment of the position of the distal end of the maximum clearance stop bolt and the elongated slot and therefore the maximum backlash adjustment.

In an embodiment, the actuator comprises a hydraulic piston.

In an embodiment, the actuator comprises a screw actuator.

In an embodiment, the actuator is connected to a bracket which, in turn, is connected to the cross shaft.

In an embodiment, each opposing end of the cross shaft is connected to a cross shaft arm which, in turn, is connected to its respective link. The links thereby connect their respective cross shaft arms to the respective mounting plates.

In an embodiment, the present invention provides a method of adjusting the backlash of a support drum assembly which applies a nip load to a reel spool. The method of the present invention comprises providing a support drum assembly as described above and thereafter actuating the actuator to move the link and the second end of the support drum vertically with respect to the first end of the support drum during operation of the papermaking machine.

In an embodiment, the method of the present invention further comprises moving the link and the second end of the support drum between a minimum backlash position and a maximum backlash position.

In an embodiment, the actuating step is carried out while the support drum is rotating.

In an embodiment, the actuating step is carried out while the papermaking machine is operating.

In an embodiment, the present invention provides a method of reeling a traveling web into a wound web roll, the method comprising the steps of moving a reel spool having a rotational axis to an initial position, engaging the reel spool in its initial position with a translationally movable support drum, rotationally driven about a rotational axis thereof, along a nip pressure line of contact therebetween, bringing a traveling web onto the reel spool in its initial position to commence winding of the web into a wound web roll thereon, moving the web roll being wound along a substantially horizontal path from the initial position to a winding position while maintaining the web roll rotatably supported and in nipping engagement with the support drum, the support drum maintaining its engagement with the wound web roll in its winding position along a nip pressure line downstream of a vertical plane through the rotational axis of the support drum, and moving one end of the support drum substantially vertically with respect to the other end of the support drum to engage the wound web roll in to maintain the nip against the wound web roll in the winding position to provide the desired nip pressure as the wound web roll increases in diameter during the reeling process.

It is therefore an advantage of the present invention to provide an improved support drum assembly whereby one end of the support drum may be raised or lowered vertically with respect to the opposing end of the support drum during operation of the papermaking machine.

It is also an advantage of the present invention to provide a means for adjusting the backlash of a support drum while the machine is in operation.

Yet another advantage of the present invention is to provide a cross shaft linkage that will allow two or more backlash settings to be used at any time during machine operation.

Another advantage of the present invention is that it provides an apparatus whereby the amount of backlash may be reduced or increased as necessary as the diameter of the web roll increases.

These and other advantages will become apparent upon reading the following detailed description and appended claims, and upon reference to the accompanying drawings.

BRIEF DESCRIPTION OF THE DRAWING

For a more complete understanding of this invention, reference should now be made to the embodiments illustrated in greater detail in the accompanying drawing and described below by way of an example of the invention.

In the drawing.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
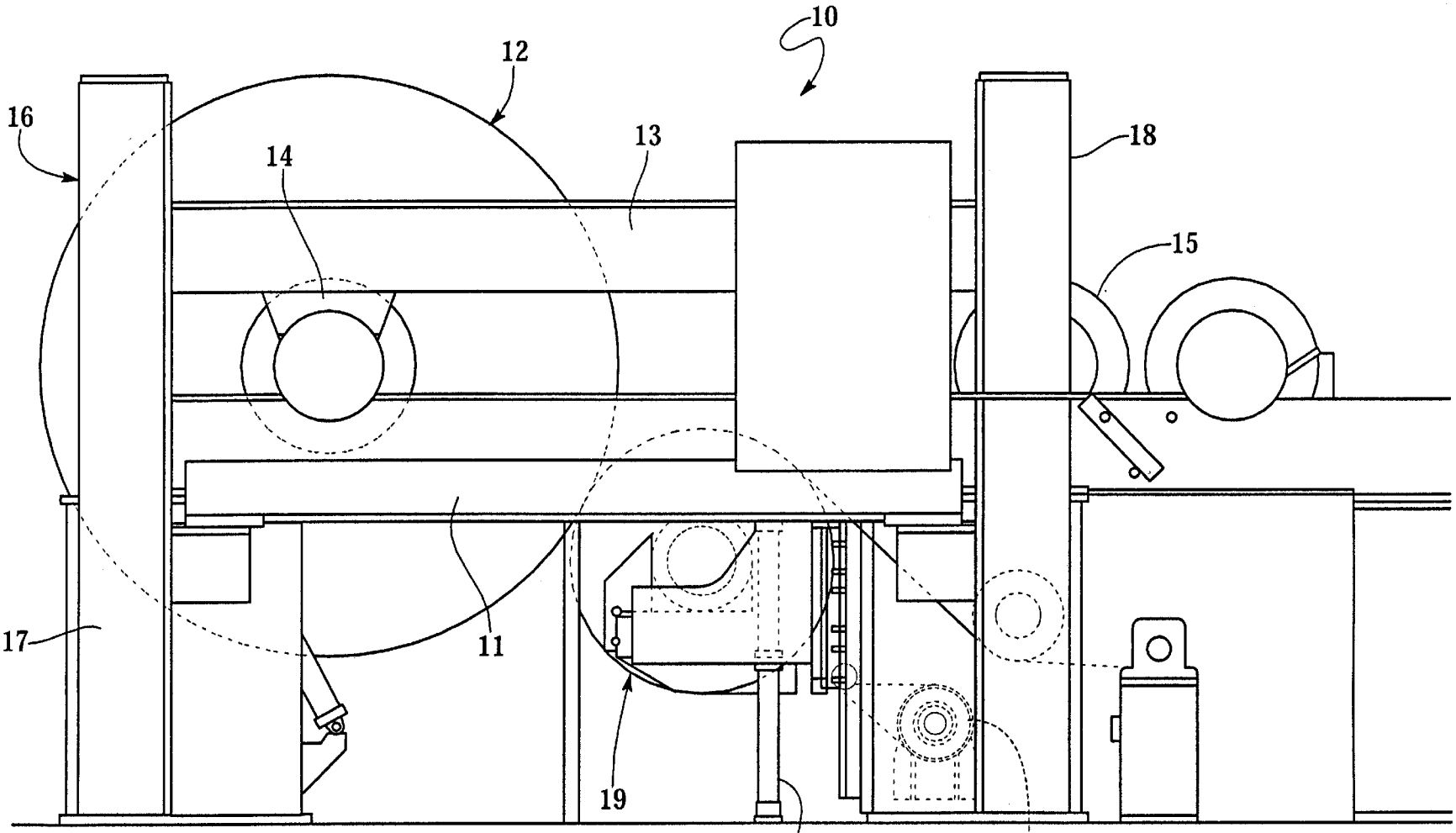
FIG. 1 is a side elevational view of a reel and support roll made in accordance with the present invention.

Turning first to FIG. 1, a reel apparatus 10 made in accordance with the present invention includes a pair of horizontal support rails, only one of which is shown at 11 which supports the spool 12. A pair of support beams, only one of which is shown at 13 is disposed above the lower support rails 11. The beam 13 includes a carriage 14 which is used to engage an empty spool, shown at 15, and moving the empty spool 15 from its initial position to the downstream position as shown for the spool 12. The frame 16, in addition to the rails 11, support beams 13 also include a pair of downstream spaced vertical beams, only one of which is shown at 17 and an upstream pair of spaced beams, only one of which is shown at 18.

The support roll is shown at 19. The function of the support roll and the general operation of the reel apparatus 10 is described in detail in U.S. Pat. Nos. 5,370,327, 5,544,481, 5,560,566 and 5,673,870 and need not be discussed in detail here. The operation of the support roll 19 and its associated assembly is discussed in greater detail below with respect to FIGS. 2–6.

Figure 2:
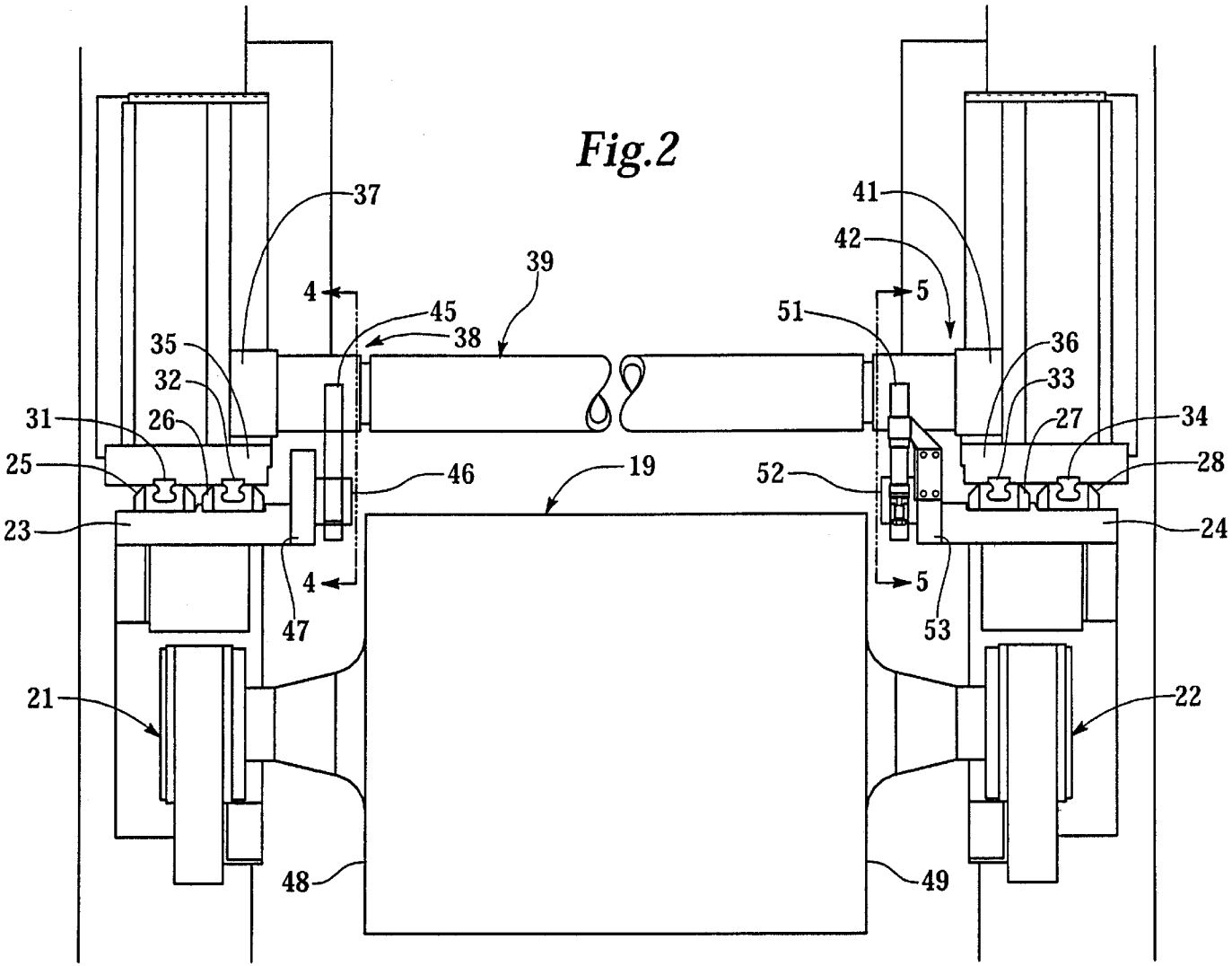
FIG. 2 is a top plan view of the support roll assembly made in accordance with the present invention and first shown in FIG. 1.

Turning to FIG. 2, the support drum 19 is supported by opposing support frames 21, 22. Each frame 21, 22 is coupled to a respective support bracket 23, 24 respectively. The support brackets 23, 24 are connected to female guide blocks 25, 26 and 27, 28 respectively. The female guide blocks 25, 26 and 27, 28 are meshed with male guide blocks 31, 32 and 33, 34 respectively. The male guide blocks 31, 32 and 33, 34 are fixedly connected to reel frames 35 and 36 respectively. The reel frame 35 being connected to a first bearing housing 37 which supports a first end 38 of the cross shaft 39. Similarly, the reel frame 36 is connected to a bearing housing 41 which, in turn, supports a second end 42 of the cross shaft 39. Returning to FIG. 1, the hydraulic actuator 43 is provided to raise and lower the drum 19.

Returning to FIG. 2, the bearing housing 37 supports a shaft arm 45 which is connected to a standard link 46. The link 46 connects the shaft arm 45 to a mounting plate 47 which, in turn, is connected to the support bracket 23. The support bracket 23 is connected to a hydraulic lifter for raising the lowering the left end 48 of the drum. The cross shaft assembly does not include a separate backlash adjustment element. In contrast, in addition to being connected to a hydraulic lifter, the right end or second end 42 of the cross shaft assembly is also equipped with a backlash adjustment linkage. Specifically, the bearing housing 41 supports a right or second cross shaft arm 51. The cross shaft arm 51 is connected to a backlash adjustment link 52 which, in turn, connects the cross shaft arm 51 to the mounting plate 53. The mounting plate 53 is connected to the support bracket 24. The connection between the cross shaft arm 51 and the mounting plate 53 is explained in greater detail in FIGS. 3, 5 and 6.

Figure 3:
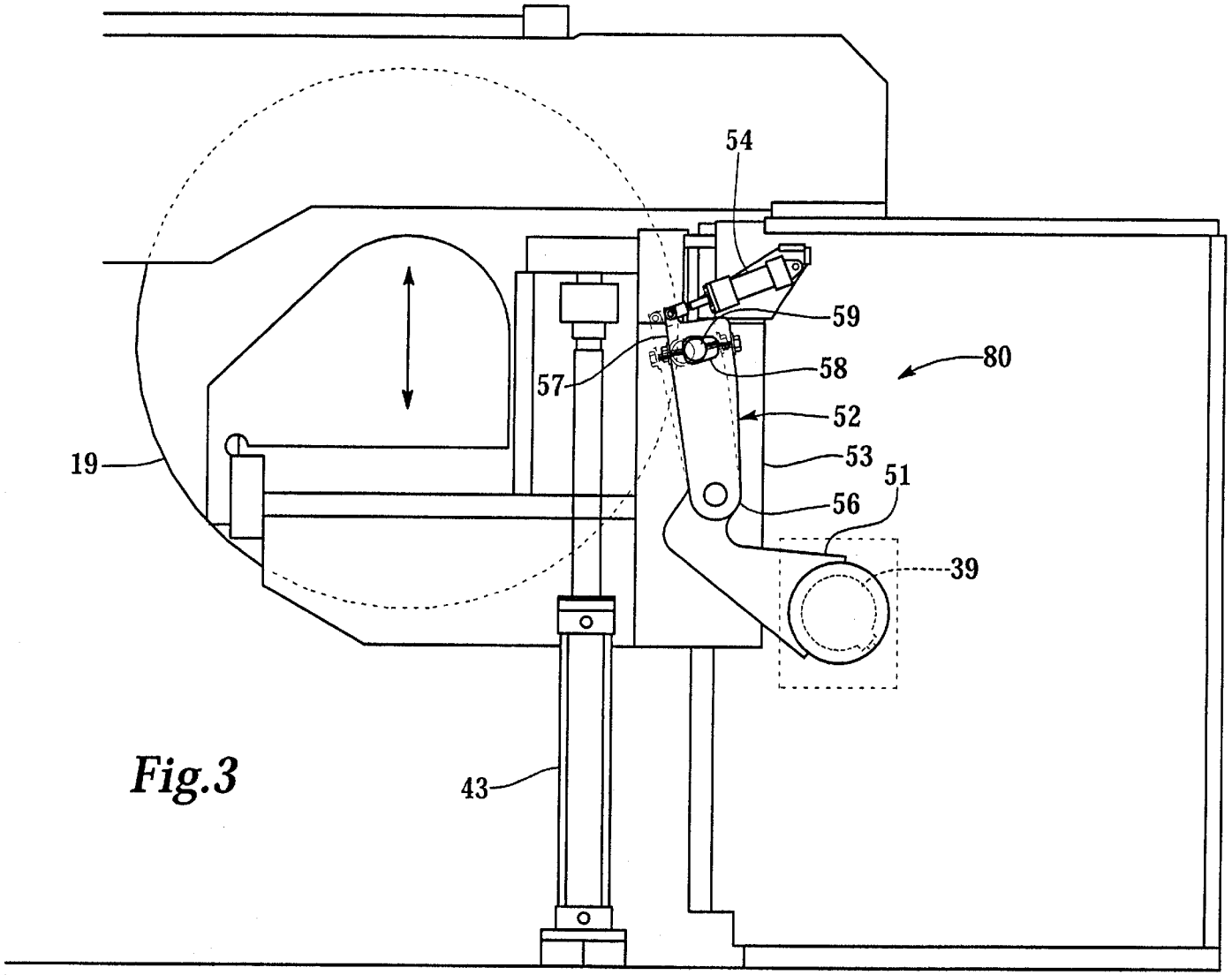
FIG. 3 is a partial side elevational view of the support drum assembly of the present invention as first shown in FIG. 1.

Turning to FIG. 3, the cross shaft arm 51 connects the cross shaft 39 to the backlash adjustment link 52 which is shown in two positions in FIG. 3. The link 52 is connected to both the mounting plate 53 and the actuator 54 which, in the embodiment illustrated, comprises a hydraulic cylinder. More specifically, a proximal end 56 of the link 52 is connected to the cross shaft arm 51 and a distal end 57 of the link 52 is connected to the actuator 54. An elongated slot 58 is disposed in the link 52 between the proximal end 56 and distal end 57. The slot accommodates a cam 59 which is attached to the mounting plate 53 as discussed below in connection with FIGS. 5 and 6.

Figure 5A:
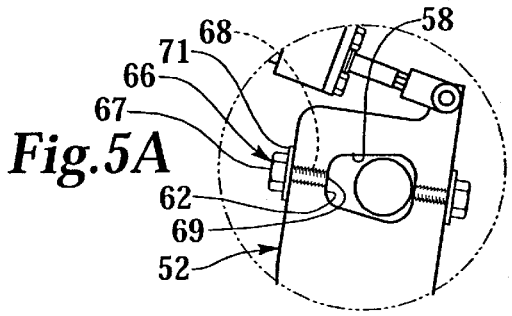
FIG. 5A is an enlarged fragmentary view of the apparatus of FIG. 5, taken at line 5A.
Figure 5:
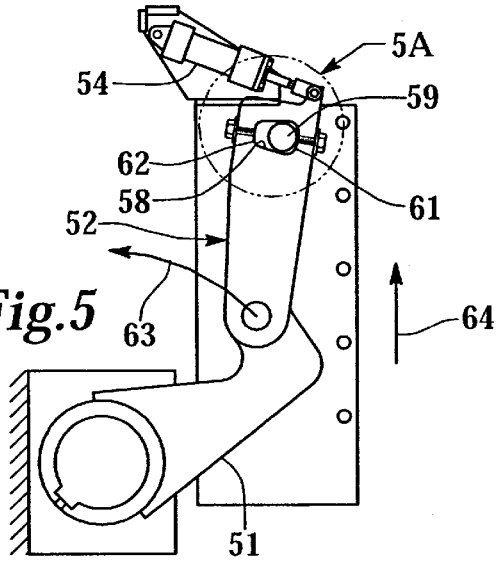
FIG. 5 is a sectional view taken substantially along line 5—5 of FIG. 2, particularly illustrating the link in a maximum backlash clearance position.
Figure 6A:
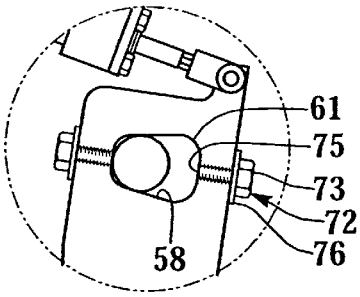
FIG. 6A is an enlarged fragmentary view of the apparatus of FIG. 6, taken at line 6A.
Figure 6:
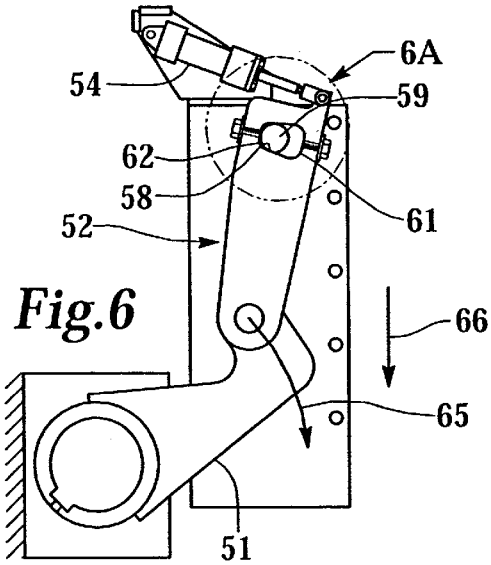
FIG. 6 is a sectional view taken substantially along line 5—5 of FIG. 2, 5particularly illustrating the link in a minimum backlash clearance position.

Specifically, turning to FIG. 5 and FIG. 5A, the actuator 54 has been withdrawn so that the cam 59 is disposed at one opposing end 61 of the slot 58. In contrast, briefly referring to FIG. 6 and FIG. 6A, it is seen that the actuator 54 has been extended so that the cam 59 is disposed at the other opposing end 62 of the slot 58. Referring back to FIG. 5, with the actuator 54 retracted as shown, the link 52 and second cross shaft arm 51 have been pulled in the direction of the arrow 63 thereby resulting in an upward vertical movement of the support drum 19 as shown by the arrow 64. Similarly, referring to FIG. 6, with the actuator 54 extended, the cam 52 engages the opposing end 62 of the slot 58 which results in a movement of the link 52 and second cross shaft arm 51 in the direction of the arrow 65 resulting in a downward vertical movement of the support drum 19 as indicated by the arrow 66. It will be noted that the actuator 54 need not be of the hydraulic type as illustrated in FIGS. 3, 5 and 6. Rather, the actuator may be a screw actuator or a gear-type actuator providing incremental movement of the link 52 and cross shaft arm 51.

Still referring to FIGS. 5 and 6, the elongated slot includes two holes at its opposing ends 61 and 62. The first end 62, accommodates a minimum clearance stop bolt 66 which includes a head 67 and a shaft 68. The shaft 68 further includes a distal end 69 which extends into the slot 58. The position of the distal end 69 of the shaft 68 may be adjusted by changing the amount of shim 71 disposed between the head 67 and the link 52. Similarly, at the second end 61 of the slot 58, a hole is provided for accommodating a maximum clearance stop bolt 72 which also includes a head 73 and a shaft 74. The shaft 74 also includes a distal end 75, the position of which in the slot 58 determines the amount of maximum backlash available. The position of the distal end 75 of the shaft 74 of course may be adjusted by adding or removing shim shown at 76.

Figure 4:
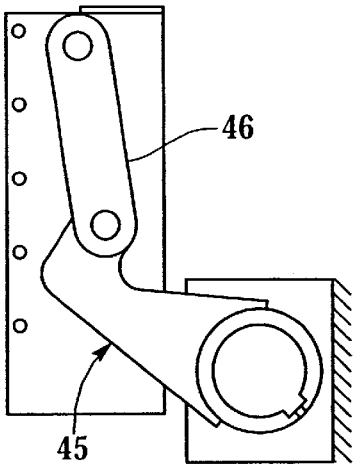
FIG. 4 is a sectional view taken substantially along line 4—4 of FIG. 2.

FIG. 4 illustrates the connection between the first cross shaft arm 45 and the standard link 46.

Thus, referring to FIG. 3, the vertical position of the support drum 19 can be primarily adjusted using the two hydraulic actuators, only one of which is shown at 43. The details of the primary upward and downward movement of the support drum 19 are more completely explained in U.S. Pat. Nos. 5,370,327 and 5,544,841. However, as set forth above, it may be necessary to vary the vertical position of one end 49 of the support drum 19 with respect to the other end 48. In this connection, the actuating mechanism shown generally at 80 in FIG. 3 can be employed to accomplish this result.

From the above description, it is apparent that the objects and advantages of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed:

1. A support drum assembly for applying a nip load to a reel spool, the support drum assembly comprising:

a support drum comprising a first end and a second end, a cross shaft comprising a first end and a second end, the first end of the cross shaft being supported by a first stationary frame, the second end of the cross shaft being supported by a second stationary frame, the first end of the cross shaft further being connected to a first drum support bracket, the first drum support bracket supporting the first end of the support drum, the second end of the cross shaft being connected to a link, the link being connected to a second drum support bracket and an actuator, the second drum support bracket supporting the second end of the support drum, the actuator moving the link and the second end of the support drum vertically with respect to the first end of the end of the support drum.

2. The support drum assembly of claim 1 wherein the link further comprises a proximal end connected to the second end of the cross shaft and a distal end connected to the actuator, the link further comprising an elongated slot disposed between the proximal and distal ends, the drum assembly further comprises a second mounting plate comprising a cam roller, the cam roller being slidably received in the elongated slot of the link, the second mounting plate being connecting the link to the second drum support bracket.

3. The support drum assembly of claim 2 wherein the elongated slot comprises a first opposing end and a second opposing end, the first opposing end of the slot further comprising a hole that extends from the first opposing end of the slot through the link, the hole accommodating a minimum clearance stop bolt comprising a distal end that extends into the elongated slot and prevents the cam roller from engaging the first opposing end of the elongated slot.

4. The support drum assembly of claim 3 wherein the minimum clearance stop bolt comprises a head disposed on an opposing side of the link from the elongated slot and a shaft that extends through the link, the drum assembly further comprising a shim disposed between the head of the minimum clearance stop bolt and the link.

5. The support drum assembly of claim 2 wherein the elongated slot comprises a first opposing end and a second opposing end, the second opposing end of the slot further comprising a hole that extends from the second opposing end of the slot through the link, the hole accommodating a maximum clearance stop bolt comprising a distal end that extends into the elongated slot and prevents the cam roller from engaging the second opposing end of the elongated slot.

6. The support drum assembly of claim 4 wherein the maximum clearance stop bolt comprises a head disposed on an opposing side of the link from the elongated slot and a shaft that extends through the link, the drum assembly further comprising a shim disposed between the head of the maximum clearance stop bolt and the link.

7. The support drum assembly of claim 1 wherein the actuator comprises a hydraulic piston.

8. The support drum assembly of claim 1 wherein the actuator comprises a screw actuator.

9. The support drum assembly of claim 1 wherein the actuator is connected to a bracket, the bracket being connected to the cross shaft.

10. The support drum assembly of claim 1 wherein the first end of the cross shaft is connected to a first cross shaft arm, the first cross shaft arm being connected to a standard link that connects the first cross shaft arm to a first mounting plate, the first mounting plate connecting the standard link to the first drum support bracket, and the second end of the cross shaft is connected to a second cross shaft arm, the second cross shaft arm being connected to the link, the link connecting the second cross shaft arm to a second mounting plate and to the actuator, the second mounting plate connecting the link to the second drum support bracket.

11. An adjustable support drum assembly for applying a nip load to a reel spool, the support drum assembly comprising:

a support drum comprising a first end and a second end, a cross shaft comprising a first end and a second end, the first end of the cross shaft being supported by a first stationary frame, the second end of the cross shaft being supported by a second stationary frame, the first end of the cross shaft further being connected to a first mounting plate, the first mounting plate being connected to a first drum support bracket, the first drum support bracket supporting the first end of the support drum, the second end of the cross shaft being connected to a link, the link being connected to a second mounting plate and an actuator, the second mounting plate being connected to a second drum support bracket, the second drum support bracket supporting the second end of the support drum, the actuator moving the link, the second mounting plate and the second end of the support drum between at least two vertical positions thereby varying the vertical position of the second end of the support drum with respect to the first end of the support drum.

12. The support drum assembly of claim 11 wherein the link comprises a proximal end connected to the second end of the cross shaft and a distal end connected to the actuator, the link further comprising an elongated slot disposed between the proximal and distal ends, the second mounting plate being connected to cam roller, the cam roller being slidably received in the elongated slot of the link.

13. The support drum assembly of claim 12 wherein the elongated slot comprises a first opposing end and a second opposing end, the first opposing end of the slot further comprising a hole that extends from the first opposing end of the slot through the link, the hole accommodating a minimum clearance stop bolt comprising a distal end that extends into the elongated slot and prevents the cam roller from engaging the first opposing end of the elongated slot.

14. The support drum assembly of claim 13 wherein the minimum clearance stop bolt comprises a head disposed on an opposing side of the link from the elongated slot and a shaft that extends through the link, the drum assembly further comprising a shim disposed between the head of the minimum clearance stop bolt and the link.

15. The support drum assembly of claim 12 wherein the elongated slot comprises a first opposing end and a second opposing end, the second opposing end of the slot further comprising a hole that extends from the second opposing end of the slot through the link, the hole accommodating a maximum clearance stop bolt comprising a distal end that extends into the elongated slot and prevents the cam roller from engaging the second opposing end of the elongated slot.

16. The support drum assembly of claim 14 wherein the maximum clearance stop bolt comprises a head disposed on an opposing side of the link from the elongated slot and a shaft that extends through the link, the drum assembly further comprising a shim disposed between the head of the maximum clearance stop bolt and the link.

17. The support drum assembly of claim 11 wherein the actuator comprises a hydraulic piston.

18. The support drum assembly of claim 11 wherein the actuator comprises a screw actuator.

19. The support drum assembly of claim 11 wherein the actuator is connected to a bracket, the bracket being connected to the cross shaft.

20. The support drum assembly of claim 11 wherein the first end of the cross shaft is connected to a first cross shaft arm, the first cross shaft arm being connected to standard link that connects the first cross shaft arm to the first mounting plate, and the second end of the cross shaft is connected to a second cross shaft arm, the second cross shaft arm being connected to the link, the link connecting the second cross shaft arm to the second mounting plate and to the actuator.

21. The support drum assembly of claim 11 wherein the at least two vertical positions include a minimum backlash position and a maximum backlash position.

22. A method of adjusting the backlash of a support drum assembly for applying a nip load to a reel spool, the method comprising the steps of:

providing a support drum assembly comprising a cross shaft comprising a first end and a second end, the first end of the cross shaft being supported by a first stationary frame, the second end of the cross shaft being supported by a second stationary frame, the first end of the cross shaft further being connected to a first drum support bracket, the first drum support bracket supporting a first end of a support drum, the support drum comprising a second end, the second end of the cross shaft being connected to a link, the link being connected to a second drum support bracket and an actuator, the second drum support bracket supporting the second end of the support drum, actuating the actuator to move the link and the second end of the support drum vertically with respect to the first end of the end of the support drum.

23. The method of claim 22 wherein the actuating step further comprises moving the link and second end of the support drum between a minimum backlash position and a maximum backlash position.

24. The method of claim 22 wherein the actuating step is carried out while the support drum is rotating.

25. A method of reeling a traveling web into a wound web roll, comprising the following steps:

moving a reel spool having a rotational axis to an initial position;

engaging the reel spool in an initial position with a translationally movable support drum, the support drum being rotatably driven about a rotational axis thereof along a nip pressure line of contact between the support drum and the reel spool;

bringing a traveling web onto the reel spool in an initial position to commence winding of the web onto the reel spool to form a wound web roll thereon;

moving the web roll from the initial position to a winding position while maintaining the web roll in nipping engagement with the support drum;

moving the support drum substantially vertically to engage the wound web roll and urging the support drum upwardly or downwardly to maintain the nipping engagement against the wound web roll in the winding position to provide the desired nip pressure as the wound web roll increases in diameter during the reeling process; and moving one end of the support drum substantially vertically with respect to the other end of the support drum to maintain a uniform nip pressure against the wound web roll as the wound web roll increases in diameter during the reeling process.

* * * * *